US008556594B2

(12) United States Patent
Kim et al.

(10) Patent No.: US 8,556,594 B2
(45) Date of Patent: Oct. 15, 2013

(54) VACUUM EJECTOR AND VACUUM APPARATUS HAVING THE SAME

(75) Inventors: Hyun-Wook Kim, Seoul (KR); Yong-Wook Kim, Hwaseong-si (KR); Tea-Jin Park, Hwaseong-si (KR)

(73) Assignee: Samsung Electronics Co., Ltd. (KR)

( * ) Notice: Subject to any disclaimer, the term of this patent is extended or adjusted under 35 U.S.C. 154(b) by 194 days.

(21) Appl. No.: 13/051,088

(22) Filed: Mar. 18, 2011

(65) Prior Publication Data

US 2011/0229346 A1 Sep. 22, 2011

(30) Foreign Application Priority Data

Mar. 18, 2010 (KR) ..... 10-2010-0024208

(51) Int. Cl.
*F04F 5/20* (2006.01)
*F04F 5/46* (2006.01)

(52) U.S. Cl.
USPC ..... 417/194; 417/197; 417/198

(58) Field of Classification Search
USPC ..... 417/194, 197, 198; 366/163.2
See application file for complete search history.

(56) References Cited

U.S. PATENT DOCUMENTS

| | | | | | |
|---|---|---|---|---|---|
| 1,739,600 | A * | 12/1929 | Loth | 417/198 |
| 2,231,090 | A * | 2/1941 | Ross | 417/54 |
| 4,834,132 | A * | 5/1989 | Sasaki et al. | 137/143 |
| 5,653,807 | A * | 8/1997 | Crumbaker | 118/715 |
| 6,969,052 | B2 * | 11/2005 | Korzeniowski | 261/76 |
| 7,784,999 | B1 * | 8/2010 | Lott | 366/163.2 |
| 2012/0148421 | A1 * | 6/2012 | Huntley | 417/85 |

FOREIGN PATENT DOCUMENTS

| | | | |
|---|---|---|---|
| JP | 05-234902 | | 9/1993 |
| JP | 09-321032 | | 12/1997 |
| KR | 100227852 | B1 | 8/1999 |
| KR | 1020020083237 | A | 11/2002 |
| SU | 1139900 | A * | 2/1985 |
| WO | WO 2006082357 | A1 * | 8/2006 |

* cited by examiner

*Primary Examiner* — Devon Kramer
*Assistant Examiner* — Nathan Zollinger
(74) *Attorney, Agent, or Firm* — Myers Bigel Sibley & Sajovec, PA

(57) ABSTRACT

A vacuum pump ejector may include ejector body and a nozzle. The ejector body may have a passageway through which fluids may flow. The passageway may have an orifice. The nozzle may inject a purging gas to the orifice. The ejector may decrease a pressure between the vacuum pump and the scrubber, so that the vacuum pump may have improved efficiency. Thus, the vacuum pump may be effectively operated.

17 Claims, 5 Drawing Sheets

VACUUM EJECTOR AND VACUUM APPARATUS HAVING THE SAME

REFERENCE TO CROSS-RELATED APPLICATION

This application claims priority under 35 USC §119 to Korean Patent Application No. 2010-0024208, filed on Mar. 18, 2010 in the Korean Intellectual Property Office (KIPO), the contents of which are herein incorporated by reference in their entirety.

BACKGROUND

1. Field

Example embodiments of the inventive concept relate to a vacuum ejector and a vacuum pump in conjunction with a vacuum ejector. More particularly, example embodiments of the inventive concept relate to a vacuum ejector used in connection with manufacturing a semiconductor device or a liquid crystal display (LCD) device, and a vacuum pump working in conjunction with the vacuum ejector.

2. Description of the Related Art

Generally, various chemicals may be used for manufacturing a semiconductor device or an LCD device. The used chemicals may be cleaned using a cleaning solution. The used chemicals may then be exhausted during the cleaning process or an additional exhausting process. An exhausting system used in the exhausting process may include a vacuum apparatus.

FIG. 1 is a block diagram illustrating a conventional vacuum apparatus.

Referring to FIG. 1, a conventional vacuum apparatus may include a vacuum pump 175 and a scrubber 300.

The vacuum pump 175 may be connected to a semiconductor fabrication line or an LCD fabrication line. The vacuum pump 175 may draw fluids generated in processes and then transport the fluids to the scrubber 300. The scrubber 300 may collect the fluids drawn by the vacuum pump 175. The scrubber 300 may chemically or physically treat the fluids to filter noxious components from the fluids.

The fluids drawn into the vacuum pump 175 may include particles used in the semiconductor fabrication processes or the LCD fabrication processes. The majority of the particles may be transported with the fluid to the scrubber 300. However, some particles may not be transmitted to the scrubber 300, and may accumulate in the vacuum pump 175 and/or a downstream pipe 205 between the vacuum pump 175 and the scrubber 300. The accumulation of the particles may reduce the capacity or efficiency of the vacuum pump 175.

The particles present from the semiconductor fabrication processes or the LCD fabrication processes may start at a relatively high temperature. The particles moved from the vacuum pump 175 to the scrubber 300, however, may be subject to cooling, so that the cooled particles may stick to and accumulate in the pipe or other downstream surfaces.

In order to remove the accumulated particles or prevent their adhesion, a heater may be adhered to the pipe 205 between the vacuum pump 175 and the scrubber 300. However, because the heater may be expensive, the cost for the vacuum system may be increased. Further, the heater may not completely remove or prevent the accumulation of the particles in the vacuum pump 175 or an outlet of the vacuum pump 175.

SUMMARY

Example embodiments of the inventive concept provide a vacuum ejector in combination with the vacuum pump that may be capable of reducing the number of particles stuck in a vacuum pump and/or a pipe between the vacuum pump and a scrubber to improve efficiency of the vacuum pump.

Example embodiments of the inventive concept also provide a vacuum apparatus including the above-mentioned ejector.

According to some example embodiments of the inventive concept, there is provided a vacuum ejector. The vacuum ejector may include an ejector body and a nozzle. The ejector body may have a passageway through which fluids may flow. The passageway may have an orifice. The nozzle may inject a purging gas to the orifice.

In some example embodiments of the inventive concept, the vacuum ejector may further include a heater for heating the purging gas.

In some example embodiments of the inventive concept, the nozzle may have a passageway with a spiral surface.

In some example embodiments of the inventive concept, the orifice may have a spiral shape on its surface.

According to some example embodiments of the inventive concept, there is provided a vacuum apparatus. The vacuum apparatus may include a vacuum pump, a scrubber and an ejector. The vacuum pump may draw fluids. The scrubber may collect the fluids drawn by the vacuum pump. The vacuum ejector may be installed between the vacuum pump and the scrubber. The ejector may include an ejector body and a nozzle. The ejector body may have a passageway through which fluids may flow. The passageway may have an orifice. The nozzle may inject a purging gas to the orifice.

According to some example embodiments of the inventive concept, the ejector may decrease a pressure between the vacuum pump and the scrubber, so that the vacuum pump may have improved efficiency. Thus, the vacuum pump may be more effectively operated. Further, power consumption for operating the vacuum pump may be decreased.

A heater may continuously heat the ejector body. Thus, particles in the fluid may less likely to be adhered in the vacuum pump and/or a pipe between the vacuum pump and the scrubber.

DETAILED DESCRIPTION OF THE EMBODIMENTS

Figure 1:
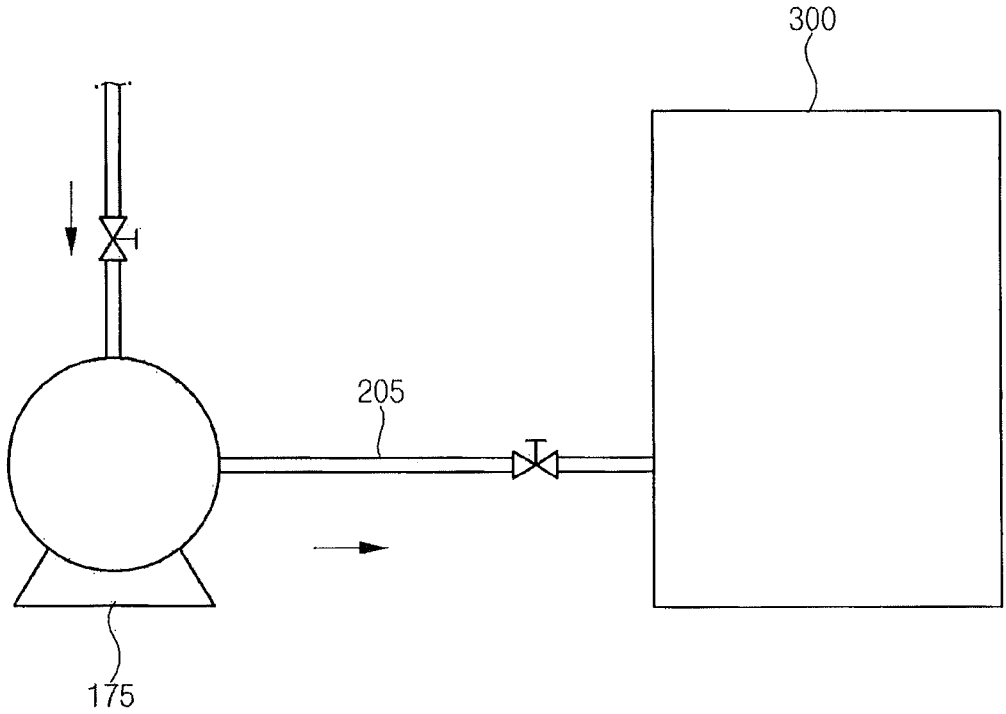
FIG. 1 (PRIOR ART)
FIG. 1 is a block diagram illustrating a conventional vacuum apparatus.

Various example embodiments of the inventive concept will be described more fully hereinafter with reference to the accompanying drawings, in which some example embodiments of the inventive concept are shown. The present invention may, however, be embodied in many different forms and should not be construed as limited to the example embodiments of the inventive concept set forth herein. Rather, these example embodiments of the inventive concept are provided so that this disclosure will be thorough and complete, and will fully convey the scope of the present invention to those skilled in the art.

It will be understood that when an element is referred to as being "on," "connected to" or "coupled to" another element or layer, it can be directly on, connected or coupled to the other element or intervening elements or layers may be present. In contrast, when an element is referred to as being "directly on," "directly connected to" or "directly coupled to" another element, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, these elements should not be limited by these terms. These terms are only used to distinguish one element from another. Thus, a first element discussed below could be termed a second element without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments of the inventive concept only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, example embodiments of the inventive concept will be explained in detail with reference to the accompanying drawings.

Figure 2:
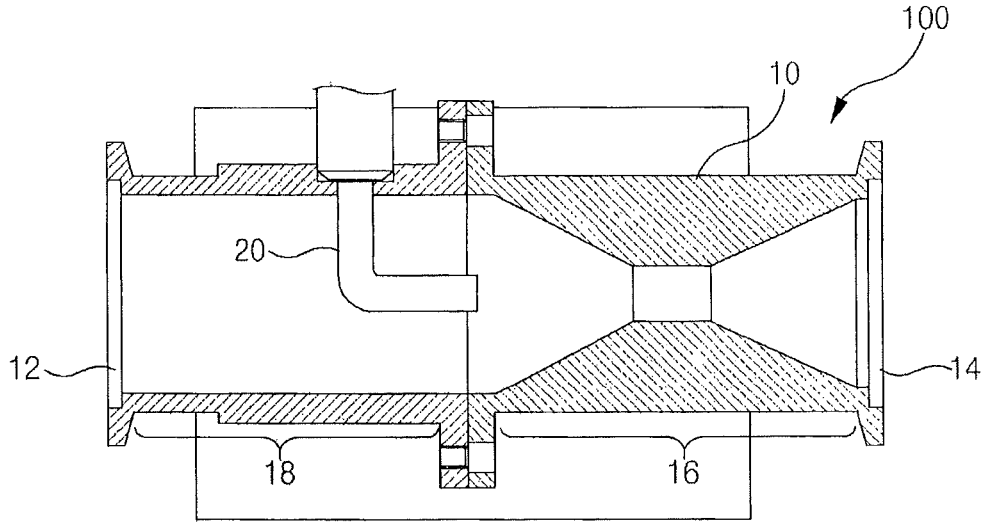
FIG. 2 is a cross-sectional view illustrating a vacuum ejector in accordance with some example embodiments of the inventive concept.

FIG. 2 is a cross-sectional view illustrating a vacuum ejector in accordance with some example embodiments of the inventive concept.

Referring to FIG. 2, a vacuum ejector 100 may include an ejector body 10 and a nozzle 20.

In some example embodiments of the inventive concept, the ejector body 10 may have a hollow cylindrical shape. Thus, the ejector body 10 may have passageway through which a fluid may flow. The passageway may have an inlet 12 and an outlet 14. Further, the passageway may have an orifice or venturi portion 16 and a non-orifice portion 18. The orifice portion 16 may have a diameter less than that of the inlet 12 and the outlet 14. The orifice portion 16 may have a gentle sloped surface configured to allow the fluid to smoothly move through the passageway. The fluid introduced into the inlet 12 may smoothly flow through the passageway. The fluid may be exhausted through the outlet 14.

In some example embodiments of the inventive concept, the nozzle 20 may be installed in the non-orifice portion 18. The nozzle 20 may inject a purging gas to the orifice portion 16. Thus, the purging gas injected from the nozzle 20 may be exhausted together with the fluid through the outlet 14. The purging gas may include air, a nitrogen gas, etc.

When the fluid has a speed below the speed of sound, the fluid passing through the outlet 14, after the orifice portion 16, may have a speed slower than that of the fluid in the orifice portion 16. In contrast, when the fluid may have a supersonic speed, the fluid passing through the outlet 14, after the orifice portion 16, may have a speed faster than that of the fluid in the orifice portion 16.

Therefore, the nozzle 20 may inject the purging gas, so that the fluid and the purging gas may be rapidly exhausted through the outlet 14.

According to this example embodiment, the ejector 100 may additionally create a relative low pressure between a vacuum pump and a scrubber. Thus, the vacuum pump may have improved efficiency as it may be working against a lower downstream pressure. Further, the time for collecting the fluid in the scrubber may be reduced. The reduced collection time may also prevent the fluid from being cooled and particles adhered on a pipe between the vacuum pump and the scrubber.

Figure 3:
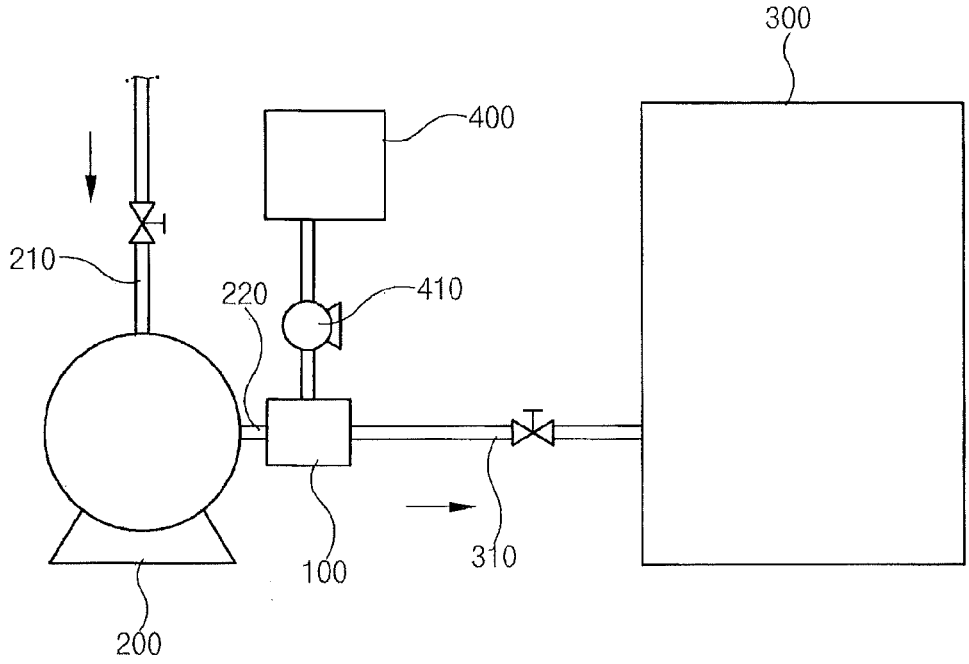
FIG. 3 is a block diagram illustrating a vacuum apparatus including the ejector of FIG. 2.

FIG. 3 is a block diagram illustrating a vacuum apparatus including the ejector in FIG. 2.

Referring to FIG. 3, a vacuum apparatus may include a vacuum ejector 100, a vacuum pump 200, a scrubber 300 and a tank 400.

The vacuum pump 200 may be connected to an inlet pipe 210 through which a fluid may flow. In some example embodiments of the inventive concept, the fluid may be used for manufacturing a semiconductor device or an LCD device.

The scrubber 300 may be connected with the vacuum pump 200 via an outlet pipe 310. The scrubber 300 may collect the fluid drawn by the vacuum pump 200 and transported through outlet pipe 310.

The vacuum ejector 100 may be coupled in-line with the outlet pipe 310. That is, the vacuum ejector 100 may be coupled between the vacuum pump 200 and the scrubber 300. Here, the vacuum ejector 100 may include elements substantially the same as those of the vacuum ejector 100 in FIG. 2.

The tank 400 may store the purging gas injected through the nozzle 20. In some example embodiments of the inventive concept, in order to rapidly inject the purging gas through the nozzle 20, a compressed purging gas may be stored in the tank 400. Alternatively, an additional pump 410 may be coupled between the tank 400 and the ejector 100, allowing for an uncompressed purging gas to be stored in the tank 400 or to provide additional pressure over that of the purging fluid in the tank 400.

According to this example embodiment, the vacuum ejector 100 may additionally form the vacuum between a vacuum pump 200 and the scrubber 300. Thus, the vacuum pump 200 may have improved efficiency for example, in terms of energy required to operate the vacuum pump. Further, the time for collecting the fluid in the scrubber 300 may be reduced. The short collection time may prevent the fluid from being cooled and particles adhered on the pipe.

Figure 4:
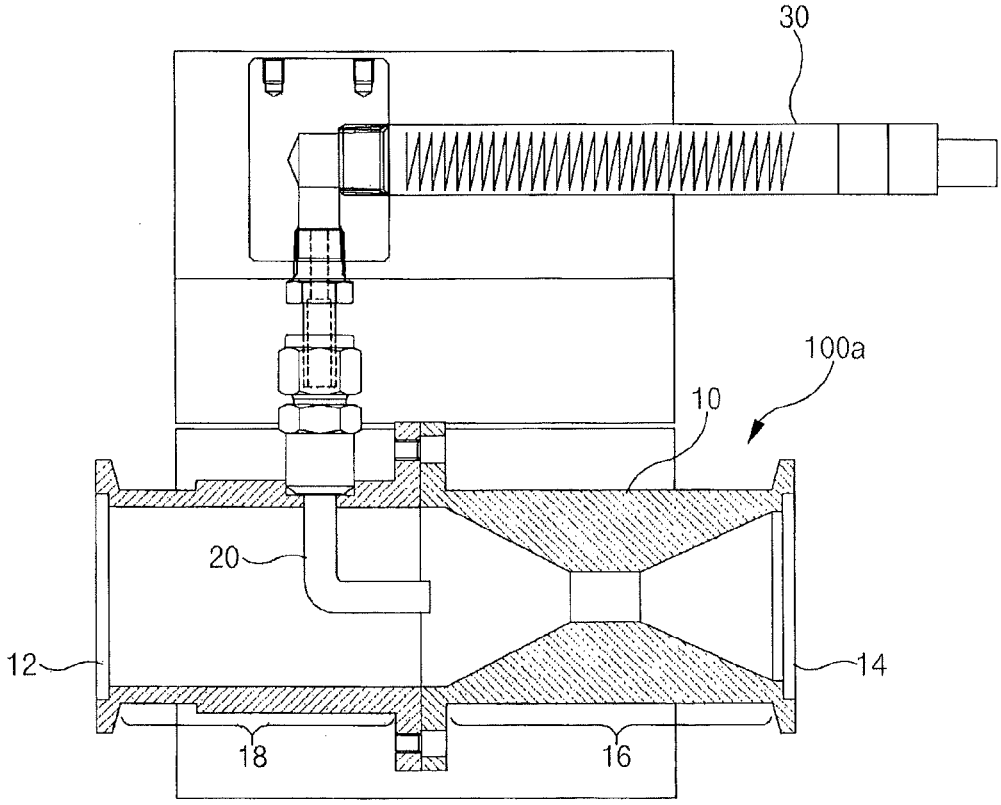
FIG. 4 is a cross-sectional view illustrating a vacuum ejector in accordance with some example embodiments of the inventive concept.

FIG. 4 is a cross-sectional view illustrating a vacuum ejector 100*a* in accordance with some example embodiments of the inventive concept.

The vacuum ejector 100*a* of this example embodiment may include elements substantially the same as those of the ejector 100 in FIG. 2 except that the vacuum ejector of this example may further include a heater 30. Thus, the same reference numerals may refer to the same elements.

Referring to FIG. 4, the vacuum ejector 100*a* may further include for heater 30. The heater 30 may heat the purging gas injected through the nozzle 20 to a temperature of about 130° C. to about 150° C. Thus, the heated purging gas may heat the fluid.

Therefore, the heater 30 may heat the purging gas that, in turn, heats the exhaust fluid that is otherwise subject to cooling during its movement between the process line and the vacuum pump 200. As a result of the heating, the fluid may not result in particles or condensate adhering in the pipe 310 may be reduced.

According to this example embodiment, the pipe may not be subject to particles or condensate adhering to exposed surfaces, so that the vacuum pump 200 may have improved efficiency.

Figure 5:
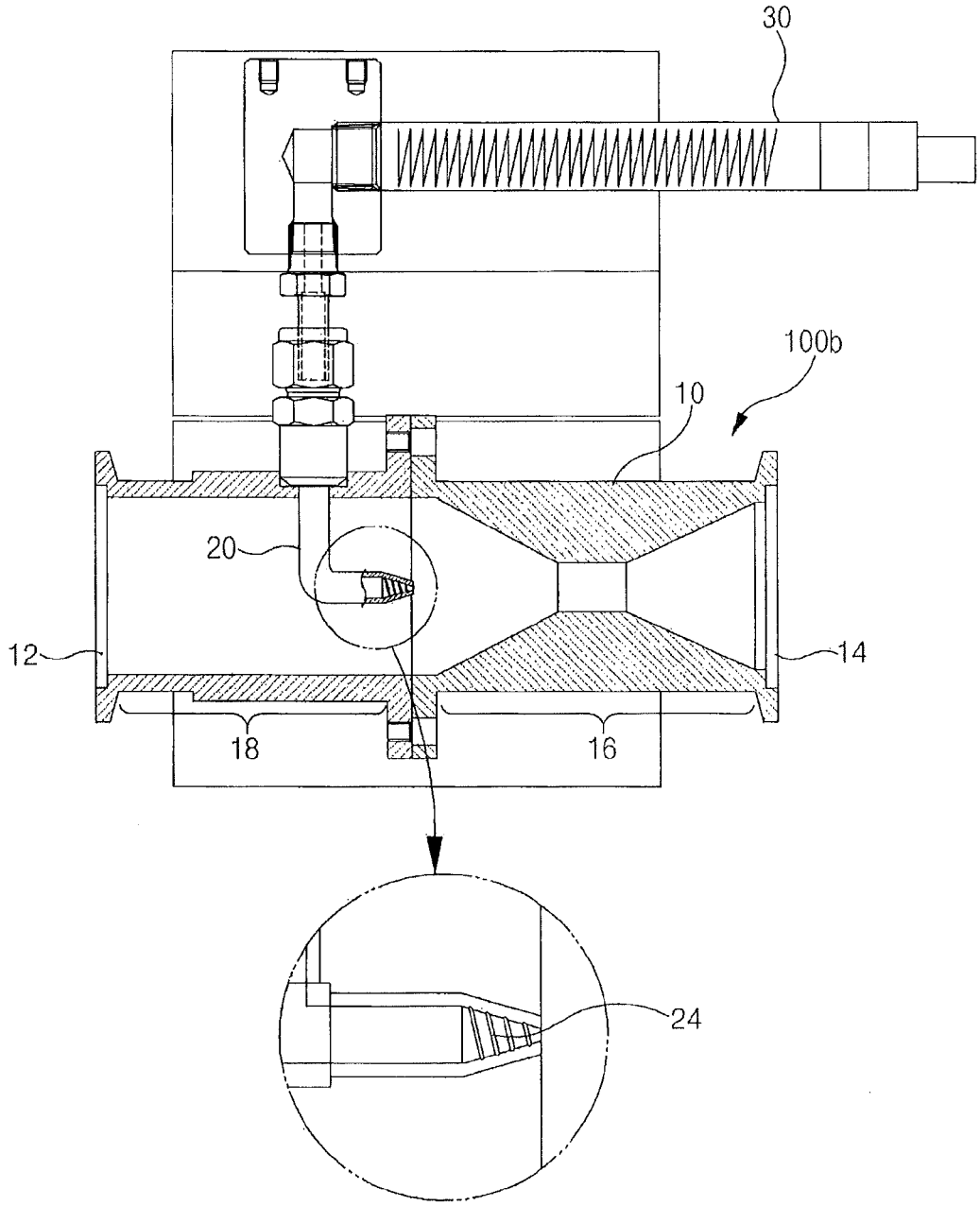
FIG. 5 is a cross-sectional view illustrating a vacuum ejector in accordance with some example embodiments of the inventive concept.

FIG. 5 is a cross-sectional view illustrating a vacuum ejector 100*b* in accordance with some example embodiments of the inventive concept.

The vacuum ejector 100*b* of this example embodiment may include elements substantially the same as those of the ejector 100*a* in FIG. 4 except for a nozzle. Thus, the same reference numerals may refer to the same elements.

Referring to FIG. 5, the interior of the nozzle 20 of the ejector 100*b* in accordance with this example embodiment may have a spiral groove 24. The spiral groove 24 may impart to the purging gas a vortex movement or flow. Thus, the purging gas may be effectively mixed with the fluid, so that the fluid and the purging gas may be smoothly moved through the passageway.

According to this example embodiment, the moving purging gas may be rapidly transported together with the fluid to the scrubber 300. Further, the heater 30 may heat the purging gas forming a vortex, so that the pipe may have reduced particles or condensate adhered to it compared to unheated purging gas.

Figure 6:
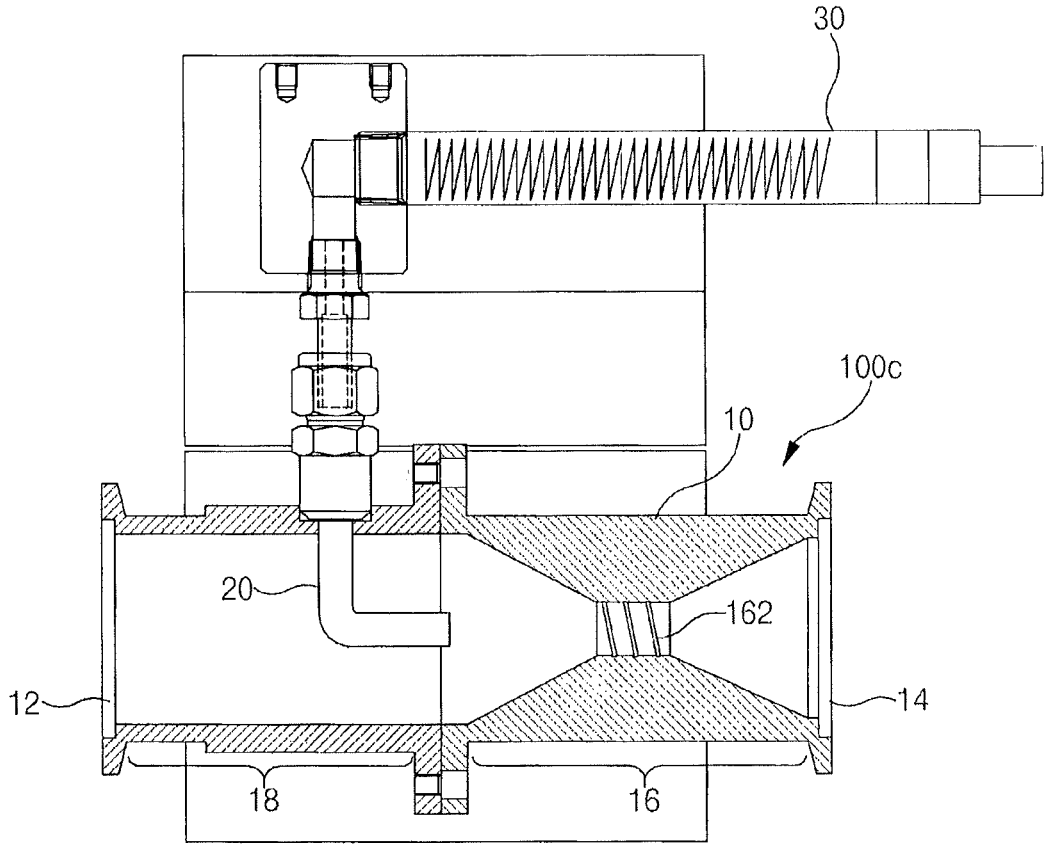
FIG. 6 is a cross-sectional view illustrating a vacuum ejector in accordance with some example embodiments of the inventive concept.

FIG. 6 is a cross-sectional view illustrating a vacuum ejector 100*c* in accordance with some example embodiments of the inventive concept.

The vacuum ejector 100*c* of this example embodiment may include elements substantially the same as those of the ejector 100*a* in FIG. 4 except for an orifice portion. Thus, the same reference numerals may refer to the same elements.

Referring to FIG. 6, the orifice portion 16 of the ejector body 10 may have a spiral groove 162. The spiral groove 162 may provide the fluid pumped by the vacuum pump 200 and the purging gas injected from the nozzle 20 with a vortex movement or flow. Thus, the purging gas may be effectively mixed with the fluid by the movement imparted by the spiral groove 162.

According to this example embodiment, the spiralling purging gas may be rapidly mixed together with the fluid and transported to the scrubber 300. Further, the heater 30 may heat the purging gas, to reduce the chance of the pipe clogging due to particles in the cooled fluid.

Figure 7:
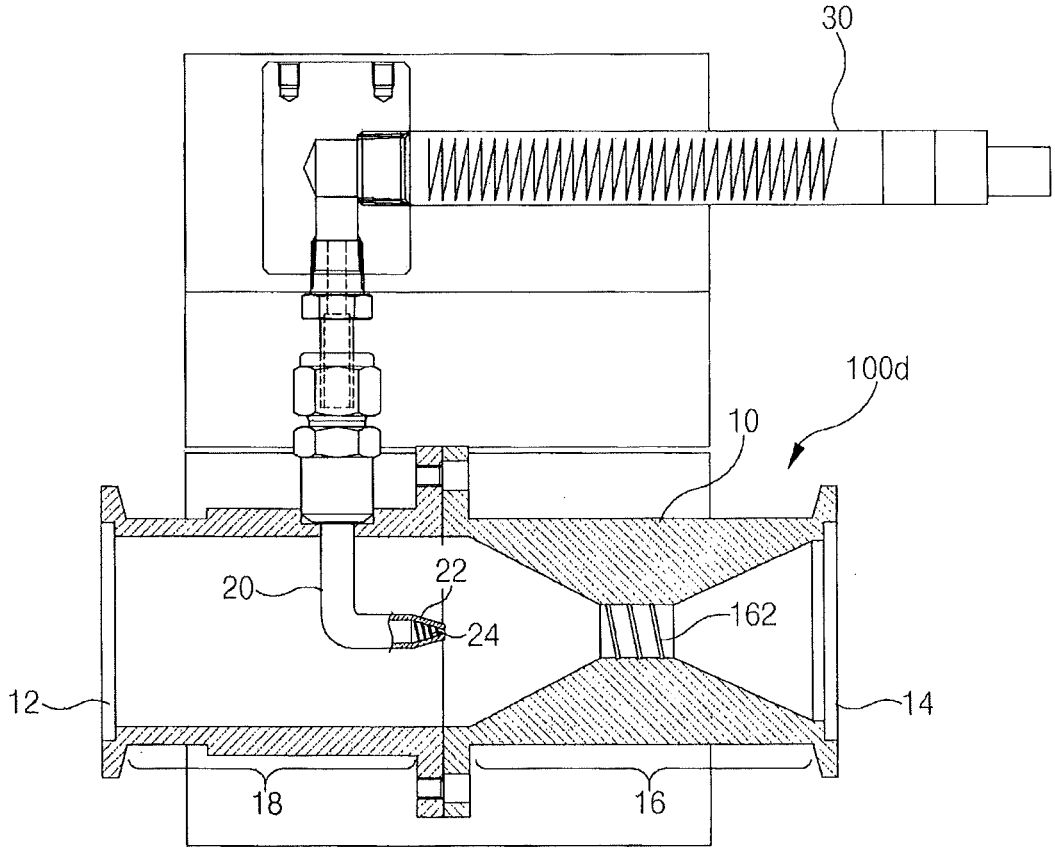
FIG. 7 is a cross-sectional view illustrating a vacuum ejector in accordance with some example embodiments of the inventive concept.

FIG. 7 is a cross-sectional view illustrating a vacuum ejector in accordance with some example embodiments of the inventive concept.

The vacuum ejector 100*d* of this example embodiment may include elements substantially the same as those of the ejector 100*a* in FIG. 4 except for a nozzle and an orifice portion. Thus, the same reference numerals may refer to the same elements.

Referring to FIG. 7, the interior of the nozzle 20 of the ejector 100*d* in accordance with this example embodiment may have a spiral groove 24. The spiral groove 24 may provide the purging gas with a vortex movement or flow. Thus, the purging gas may be effectively mixed with the fluid, so that the fluid and the purging gas may be efficiently moved through the passageway.

Further, the orifice portion 16 of the ejector body 10 may have a spiral groove 162. The spiral groove 162 may function as to impart a vortex or spiral movement or flow to the fluid pumped by the vacuum pump 200 and the purging gas injected from the nozzle 20. Thus, the purging gas may be effectively mixed with the fluid due to the spiral groove 24 and the spiral groove 162.

According to this example embodiment, the spiralling purging gas may be rapidly moved together with the fluid to the scrubber 300. Further, the spiral purging gas may be mixed with the spiral fluid in the spiral orifice portion 162. Furthermore, the heater may heat the purging gas, so that the pipe may have reduced clogging due to the particles in the cooled fluid.

According to some example embodiments of the inventive concept, the vacuum ejector may decrease the pressure between the vacuum pump and the scrubber, so that the vacuum pump may have improved efficiency. Thus, the vacuum pump may be more effectively operated. Further, power consumption for operating the vacuum pump may be decreased. In some embodiments of the inventive concept, the heater may continuously heat the ejector body. Thus, a reduced number of particles in the fluid may be accumulated in the vacuum pump and/or a pipe between the vacuum pump and the scrubber.

The foregoing is illustrative of example embodiments of the inventive concept and is not to be construed as limiting thereof. Although a few example embodiments of the inventive concept have been described, those skilled in the art will readily appreciate that many modifications are possible in the example embodiments of the inventive concept without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of various example embodiments of the inventive concept and is not to be construed as limited to the specific example embodiments of the inventive concept disclosed, and that modifications to the disclosed example embodiments of the inventive concept, as well as other example embodiments of the inventive concept, are intended to be included within the scope of the appended claims.

What is claimed is:

1. An evacuator apparatus comprising:

a vacuum pump for creating a negative pressure to draw a fluid;

a scrubber for collecting the fluid drawn by the vacuum pump; and a vacuum ejector coupled between the vacuum pump and the scrubber, the ejector including:

an ejector body that has a passageway having an orifice through which the fluid drawn by the vacuum pump flows;

a nozzle installed at the ejector body to inject a purging gas to the orifice to form a mix of the fluid drawn by the vacuum pump and the purging gas and to create a relative low pressure between the vacuum pump and the scrubber to aid transport of the mix of the fluid drawn by the vacuum pump and purging gas to said scrubber; and a heater to heat the purging gas to a temperature higher than an initial temperature of the fluid drawn by the vacuum pump such that the mix of the fluid drawn by the vacuum pump and the purging gas has a temperature higher than the initial temperature of the fluid drawn by the vacuum pump.

2. The evacuator apparatus of claim 1 wherein said fluid is exhausted from a manufacturing process for a semiconductor or LCD line.

3. The evacuator apparatus of claim 1 further comprising a purging gas source in fluid communication with the nozzle, wherein the heater is positioned between the purging gas source and the nozzle to heat said purging gas before said nozzle.

4. The evacuator apparatus of claim 1, wherein the nozzle has a passageway having an interior surface including a spiral shaped groove.

5. The evacuator apparatus of claim 1, wherein the orifice has an interior surface including a spiral shaped groove.

6. The evacuator apparatus of claim 1, wherein:

the nozzle has a passageway having an interior surface including a spiral shaped groove; and the orifice has an interior surface including a spiral shaped groove.

7. An exhaust assembly for a semiconductor or LCD manufacturing process comprising:

a vacuum pump for drawing off exhaust from said process;

a vacuum ejector assembly including:

an ejector body including a longitudinally extending passageway having an inlet in fluid communication with the vacuum pump and an opposing outlet, the longitudinally extending passageway having a non-orifice portion and an orifice portion, the non-orifice portion extending longitudinally from the inlet to the orifice portion, the orifice portion extending longitudinally from the non-orifice portion to the outlet; and a nozzle disposed in the ejector body passageway for injecting compressed fluid into a venturi in the orifice portion of the longitudinally extending passageway to draw said exhaust from said vacuum pump;

a heater configured to heat the compressed fluid and thereby raise the temperature of the exhaust after injection of the compressed fluid from the nozzle; and a scrubber in fluid communication with the outlet to receive the exhaust from said vacuum ejector assembly.

8. The exhaust assembly of claim 7, wherein the nozzle has a passageway having an interior surface including a spiral shaped groove.

9. The exhaust assembly of claim 7, wherein the venturi has an interior surface including a spiral shaped groove.

10. The exhaust assembly of claim 7, wherein:

the nozzle has a passageway having an interior surface including a spiral shaped groove; and the venturi has an interior surface including a spiral shaped groove.

11. The exhaust assembly of claim 7, further comprising a compressed fluid source tank, wherein the heater is disposed between the compressed fluid source tank and the nozzle such that the compressed fluid is heated upstream of the nozzle.

12. A vacuum apparatus, comprising:

a vacuum pump configured to draw a fluid;

a scrubber configured to receive the fluid drawn by the vacuum pump;

a purging gas tank; and a vacuum ejector positioned between the vacuum pump and the scrubber, the vacuum ejector comprising:

an ejector body including a longitudinally extending passageway having an inlet in fluid communication with the vacuum pump and an opposing outlet in fluid communication with the scrubber, the longitudinally extending passageway having a non-orifice portion and an orifice portion, the non-orifice portion extending longitudinally from the inlet to the orifice portion, the orifice portion extending longitudinally from the non-orifice portion to the outlet;

a nozzle in fluid communication with the purging gas tank, the nozzle disposed in the longitudinally extending passageway and configured to inject a purging gas received from the purging gas tank into an orifice in the orifice portion of the longitudinally extending passageway to form a mix of the fluid drawn by the vacuum pump and the purging gas and to create a relative low pressure between the vacuum pump and the scrubber to aid transport of the mix of the fluid drawn by the vacuum pump and purging gas to the scrubber; and a heater to heat the purging gas to a temperature higher than an initial temperature of the fluid drawn by the vacuum pump such that the mix of the fluid drawn by the vacuum pump and the purging gas has a temperature higher than the initial temperature of the fluid drawn by the vacuum pump, wherein the heater is positioned between the purging gas tank and the nozzle such that the purging gas is heated upstream of the nozzle.

13. The exhaust assembly of claim 12, wherein the nozzle has a passageway having an interior surface including a spiral shaped groove.

14. The exhaust assembly of claim 12, wherein at least a portion of the orifice portion of the longitudinally extending passageway has an interior surface including a spiral shaped groove.

15. The exhaust assembly of claim 12, wherein:

the nozzle has a passageway having an interior surface including a spiral shaped groove; and at least a portion of the orifice portion of the longitudinally extending passageway has an interior surface including a spiral shaped groove.

16. The exhaust assembly of claim 12, wherein the purging gas tank contains pressurized purging gas.

17. The exhaust assembly of claim 12, further comprising a pump disposed between the purging gas tank and the nozzle, the pump configured to supply pressurized purging gas to the nozzle.

* * * * *